United States Patent [19]

Keys

[11] 4,205,620

[45] Jun. 3, 1980

[54] PILL DISPENSING ASSEMBLY

[76] Inventor: Marva J. Keys, 300 S. Whiting St., Apt. T-23, Alexandria, Va. 22304

[21] Appl. No.: 966,191

[22] Filed: Nov. 30, 1978

[51] Int. Cl.[2] ..... G09F 9/00

[52] U.S. Cl. ..... 116/308; 211/75; 211/76

[58] Field of Search ..... 116/298, 299, 307, 308; 211/75, 76; 206/534, 528

[56] References Cited

U.S. PATENT DOCUMENTS

| | | | |
|---|---|---|---|
| 84,950 | 12/1868 | Kennedy | 211/77 |
| 387,192 | 7/1888 | Velie | 116/308 |
| 418,793 | 1/1890 | Hawn | 116/308 |
| 692,166 | 1/1902 | Schaffer | 116/308 |
| 3,596,629 | 8/1971 | English | 116/308 |

*Primary Examiner*—Donald F. Norton

*Attorney, Agent, or Firm*—Cushman, Darby & Cushman

[57] ABSTRACT

A pill dispensing assembly for conveniently supporting a plurality of pill containers for easy access, with indicia provided to indicate when the last pill was taken, or the next pill is to be taken. A plate has a number of apertures therein corresponding to the number of pill containers desirably to be supported by the assembly. The pill containers extend through the plate apertures generally downwardly, and a pivoted cover is provided for covering all of the pill containers at the same time. The indicator is mounted above the plate and is manually advanceable, and preferably a cup member is provided below the plate for containing the lids from the pill container supported by the plate. The entire assembly is preferably supported on a wall bracket.

8 Claims, 4 Drawing Figures

PILL DISPENSING ASSEMBLY

BACKGROUND AND SUMMARY OF THE INVENTION

The invention relates to a pill dispensing assembly. For people who are required to take pills every day, especially a variety of pills, it is highly desirable to have the pills mounted in a simple and convenient manner in a readily accessible location so that easy access can be gained to the pills. Additionally, it is desirable to provide such an assembly with readily utilizable indicia means for indicating when the last pill was taken, or when the next pill is to be taken, so that the individual utilizing the assembly can be confident that the pill has been taken, or when it should be taken. Such an assembly also should be inexpensive to make, and be readily constructed with common materials.

According to the present invention, a pill dispensing assembly is provided which is simple and easy to make, provides for convenient positioning of a plurality of pill containers, and provides simple indicia means associated therewith. In particular, the pill dispensing assembly according to the present invention comprises:

means for supporting a plurality of pill containers, including a plate having a plurality of apertures therein corresponding to the number of pill containers to be supported thereby;

indicating means operatively associated with the plate, and advancing means for advancing the indicating means so that a desired indicia is visible;

means for supporting the indicating and advancing means adjacent the plate; and means for supporting the plate in a generally horizontally extending position so that the pill containers supported thereby extend generally downwardly through the apertures formed in the plate. Desirably, a cover is provided common to all of the apertures formed in the plate for covering all of the pill containers at the same time, the cover preferably comprising a second plate mounted for pivotal movement with respect to the pill container supporting plate, and pivotal about an axis generally parallel to a plane containing the pill container supporting plate.

Means are also provided for supporting lids removed from the pill container supported by the plate, in a readily accessible position in close proximity to the plate, the lid supporting means comprising a cup member supported by the plate supporting means adjacent the plate and extending generally parallel to the plate. A common supporting means preferably is provided for the pill container supporting plate, indicating means, and cup-shape member, such common support including an elongated rod extending generally perpendicular to the plane of said plate, and having a keyed passageway formed therein for cooperation with a key extending from a wall bracket to mount the entire assembly on a wall.

It is the primary object of the present invention to provide a simple and convenient assembly for mounting a plurality of pill containers. This and other objects of the invention will become clear from an inspection of the detailed description of the invention, and from the apended claims.

BRIEF DESCRIPTIONS OF THE DRAWINGS

DETAILED DESCRIPTION OF THE DRAWINGS

Figure 1:
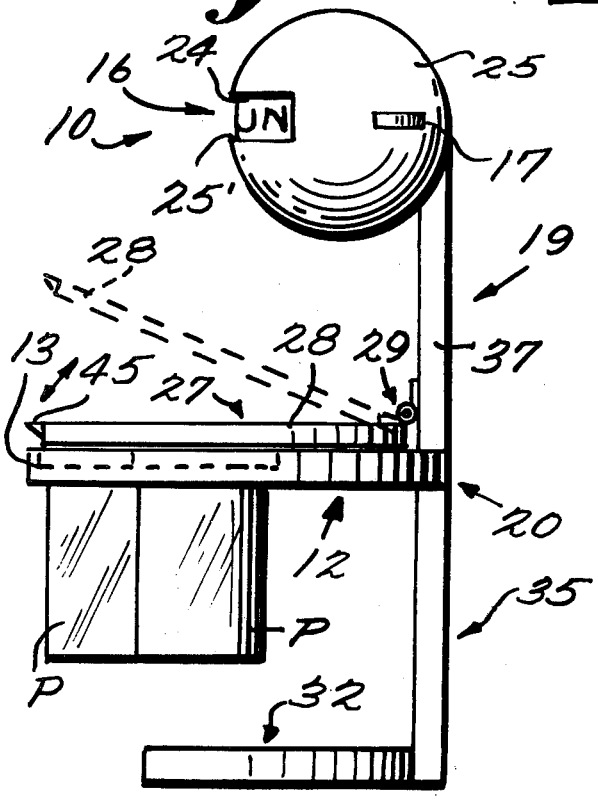
FIG. 1 is a side view of an exemplary assembly according to the present invention.
Figure 3:
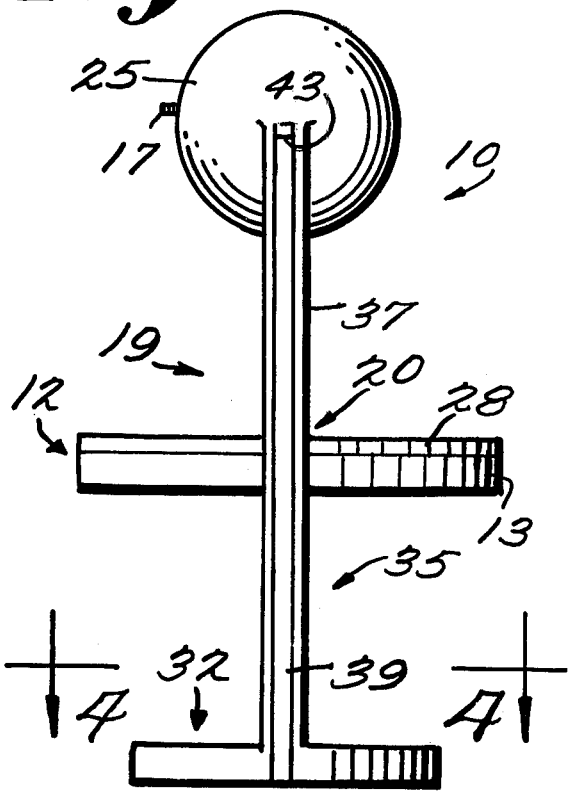
FIG. 3 is a rear view of the assembly FIG. 1.
Figure 2:
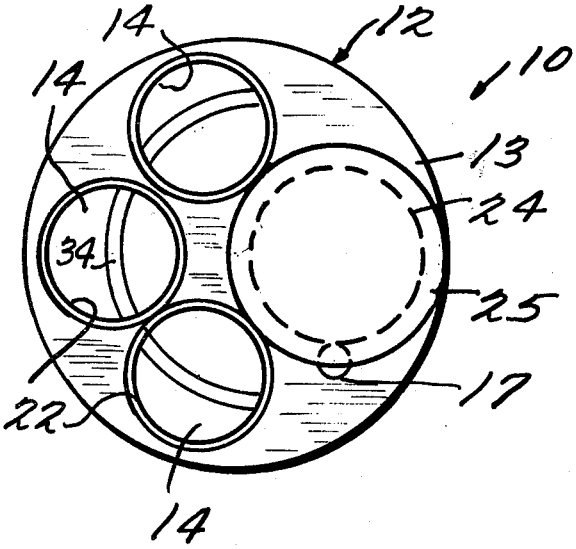
FIG. 2 is a top plan view of the assembly of FIG. 1 with the pill containers and common cover removed for clarity.

An exemplary pill dispensing assembly according to the present invention is shown generally at 10 in FIGS. 1–3. The basic components of the assembly 10 include: Means 12 for supporting a plurality of pill containers P (see FIG. 1), the means 12 comprising a plate 13 having means defining a plurality of apertures 14 (see FIG. 2) therein corresponding to the number of pill containers P to be supported by the plate 13. Indicating means 16 are operatively associated with the plate 13, and manually actuatable advancing means 17 are provided for advancing indicating means 16 so that a desired indicia is visible (see FIG. 1). Means 19 are provided for supporting the indicating and advancing means 16, 17 adjacent the plate 13, and means 20 are provided for supporting the plate 13 in a generally horizontally extending position so that the pill containers P supported thereby extend generally downwardly through the aperture 14 (see FIG. 1).

The means defining the apertures 14 in the plate 13 preferably include ledges (e.g. circumferential ledges) 22 associated with each aperture 14 for engaging a lip portion of a pill container P (such as a lip-portion surrounding the opened mouth of conventional pill containers) to be supported therein for supporting the pill container P as it extends through the respective plate aperture 14. The indicating means 16 and manually actuable advancing means 17 are shown schematically in FIGS. 1 and 2. The indicating means 16 preferably comprises a rotatable member 24 (see dotted line representation in FIG. 2) with the days of the week imprinted thereon (see FIG. 1), the member 24 being rotatable with respect to a casing, such as the spherical casing 25 illustrated in the drawings. The rotatable member 24 can have a gear portion formed around the circumference thereof, and cooperating with a gear circumferential portion of the manually rotatable advancing means 17 so that rotation of the means 17 effects rotation of the member 24.

The invention further comprises a covering means 27 common to all of the apertures 14 formed in the plate for covering all of the pill containers P supported thereby at the same time. The covering means 27 preferably comprises a second plate 28 mounted for pivotal movement with respect to the plate 13, and pivotal about an axis generally parallel to a plane containing the plate 13. For instance, a conventional hinge may be provided connected between the plate 28 and indicating means supporting means 19, as indicated at 29 in FIG. 1.

Figure 4:
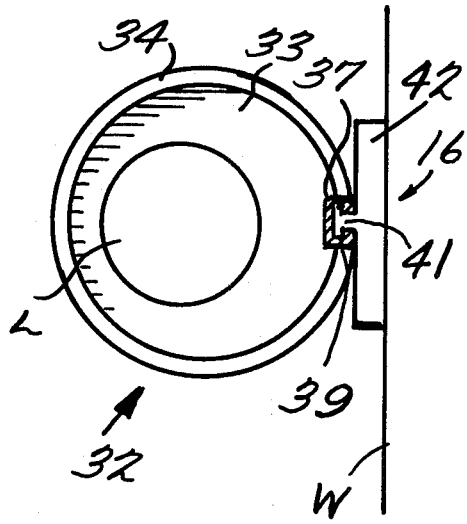
FIG. 4 is a cross-sectional view taken along lines 4—4 of FIG. 3.

Since the common cover 27 is provided for all of the pill containers P supported by the plate 13, it is not necessary to utilize the individual covers on the conventional pill containers P. In order to support the covers from the conventional pill containers P in a readily accessible position, however, in case it is desirable to remove the pill containers from the assembly 10 for refilling, for travelling, etc, means 32 preferably are provided for supporting the lids removed from the pill containers P in a readily accessible position in close proximity to the plate 13. Such means 32 are shown in detail in FIG. 4, and preferably comprise a cup member having a flat central portion 32 surrounded by a circumferential raised ridge 34, lids L being supported within a cup member and a surface 33, contained by the ridge 34. Means 35 are provided for supporting the cup member (means 32) adjacent the plate 13, and extending generally parallel to the plate 13.

Preferably, the supporting means 19, 20, and 35 comprise a single elongated rod 37, the rod being rigidly attached to the means 32, plate 13, and casing 25, and preferably extending in a dimension of elongation perpendicular to the plane of the plate 13. Preferably means are associated with the rod 37 for ready attachment of the rod to a wall W (see FIG. 4). Such ready attachment means may take the form of a key-way passage 39 (see FIGS. 3 and 4) formed in the back of the rod 37 and adapted to receive a key member 41 rigidly connected to a bracket 42 which in turn is mounted to the wall W. The bracket 42 supporting key 41 may be mounted to the wall W by any suitable means, such as adhesive, screws, or the like. An abuttment surface 43 (see FIG. 3) is provided at the top of the passageway 39 for abutting the top of the key 41 and preventing further relative movement between the key 41 and rod 37.

In order to facilitate pivotal movement of the cover 28 to gain access to the pills within the containers P, a ledge 45 may be provided (see FIG. 1) on a peripheral portion of the member 28. Additionally, if desired—such as in a situation where small children will often be present—some sort of child-proof latching mechanism can be provided between the member 28 and the plate 13 to prevent relative pivotal movement therebetween without release of the child-proof latching mechanism.

An exemplary assembly according to the present invention having being described, a typical manner of use thereof will now be set forth:

An individual mounts a bracket 42 having a key 41 formed thereon to a wall W, and then places the bottom of the key-way passage 39 of rod 37 over the key 41, and the entire assembly 10 is moved downwardly over the key 41 until the abuttment 43 comes into contact with the key 41. The assembly 10 is then mounted on wall with the plate 13 in a generally horizontal position.

The lids L are removed from a plurality of pill containers, the cover 28 is pivoted upwardly to allow access to the apertures 14 in the plate 13, and the conventional pill containers P are inserted through the apertures 14, the lips of the containers P abutting the ledges 22 of the apertures 14. The lids L are placed in the receiving means 32, and the assembly 10 is ready for use.

When it is necessary or desirable for a person utilizing assembly 10 to take a pill from one of the containers P, that person grabs the ledge 45, pivots the cover 28 about the horizontal axis moving it out of covering engagement with the containers P, removes a pill from one or more of the containers P, and then pivots the cover 28 back downwardly into covering relationship with the apertures 14. The advancing wheel 17 is then rotated, which rotates the wheel 24 having the date indicia formed thereon, and a new date appears through the aperture 25' (see FIG. 1) formed in the casing 25 for the wheel 24. This process is repeated as necessary.

When the containers P become empty, or when the person requiring the medication will be travelling, etc., the cover 28 is again pivoted upwardly, the individual pushes upwardly on the bottoms of the containers P so that they can be grasped from above the plate 13 and removed from the apertures 14, the lids L are removed from the supporting means 32 and placed on the containers P, and the cover 28 is closed. The entire assembly 10 can also be readily removed merely by sliding the rod 37 upwardly with respect to the key 41 until the keyed passageway 39 disengages the key 41, the spherical shape of the casing 25 being eminently suitable for effecting relative vertical movement between the keyway 41 and rod 37.

Thus, it will be seen that according to the present invention a pill dispensing assembly has been provided which is simple and easy to construct and use, and which provides ready access to a plurality of different pill containers, and provides conveniently mounted indicia means for indicating when a pill has last being taken or is to be taken. While the invention has been herein shown and described in what is presently concieved to be the most practical and preferred embodiment thereof, it will be apparent to those or ordinary skill in the art that many modifications may be made thereof within the scope of the invention, which scope is to be accorded the broadest interpretation of the appended claims in order to encompass all equivalent structures and devices.

What is claimed is:

1. A pill dispensing assembly comprising means for supporting a plurality of pill containers, said means comprising a plate having means defining a plurality of apertures therein corresponding to the number of pill containers to be supported thereby;

indicating means operatively associated with said plate and advancing means for advancing said indicating means so that a desired indicia is visible;

means for supporting said indicating and advancing means adjacent said plate;

means for supporting said plate in a generally horizontally extending position so that the pill containers supported thereby extend generally downwardly through the apertures formed therein;

a covering means common to all of the apertures formed in said plate for covering all of the pill containers supported thereby at the same time; and means for supporting lids, removed from the pill containers supported by said plate, in a readily accessible position in close proximity with said plate, said lids supporting means comprising a cup member supported by said plate supporting means adjacent said plate, and extending generally parallel to said plate.

2. An assembly as recited in claim 1 wherein said means for supporting said plate and said cup member comprises an elongated member having a keyed passageway therein adapted to cooperate with a wall-mounted bracket having an interfitting key member.

3. A pill dispensing assembly comprising means for supporting a plurality of pill containers, said means comprising a plate having means defining a plurality of apertures therein corresponding to the number of pill containers to be supported thereby;

indicating means operatively associated with said plate and advancing means for advancing said indicating means so that a desired indicia is visible;

means for supporting said indicating and advancing means adjacent said plate;

means for supporting said plate in a generally horizontally extending position so that the pill containers supported thereby extend generally downwardly through the apertures formed therein; and wherein said means for supporting said indicating means and said means for supporting said plate comprises an elongated member having a dimension of elongation perpendicular to the plane of said plate, and interconnecting said plate and said indicating means.

4. A pill dispensing assembly comprising means for supporting a plurality of pill containers, said means comprising a plate having means defining a plurality of apertures therein corresponding to the number of pill containers to be supported thereby;

indicating means operatively associated with said plate and advancing means for advancing said indicating means so that a desired indicia is visible;

means for supporting said indicating and advancing means adjacent said plate;

means for supporting said plate in a generally horizontally extending position so that the pill containers supported thereby extend generally downwardly through the apertures formed therein;

means for supporting lids, removed from the pill containers supported by said plate, in a readily accessible position in close proximity with said plate;

said lid supporting means, said indicating means supporting means, and said plate supporting means comprise a common elongated rod member; and means associated with said rod member for ready attachment of said rod member to a wall.

5. A pill dispensing assembly comprising means for supporting a plurality of pill containers, said means comprising a first plate having means defining a plurality of apertures therein corresponding to the number of pill containers to be supported thereby;

indicating means operatively associated with said plate and advancing means for advancing said indicating means so that a desired indicia is visible;

means for supporting said indicating and advancing means adjacent said plate;

means for supporting said plate in a generally horizontally extending position so that the pill containers supported thereby extend generally downwardly through the apertures formed therein; and a covering means, separate and distinct from said indicating means, common to all of the apertures formed in said plate for covering all of the pill containers supported thereby at the same time, said covering means comprising a second plate mounted for pivotal movement with respect to said first plate and pivotal about an axis generally parallel to a plane containing said first plate.

6. An assembly as recited in claim 5 further comprising means for supporting lids, removed from the pill containers supported by said plate, in a readily accessible position in close proximity with said plate.

7. An assembly as recited in claim 5 wherein said indicating means comprises a rotatable member having the days of the week imprinted thereon, said member being rotatable with respect to a casing, and only a portion of said member being visible through an aperture in said casing.

8. An assembly as recited in claim 5 wherein said means defining the apertures in said plate for pill containers include ledges associated with each aperture for engaging a lip portion of a pill container to be supported therein for supporting the pill container as it extends though the respective plate aperture.

* * * * *